United States Patent [19]

Becker et al.

[11] 4,109,904

[45] Aug. 29, 1978

[54] PASSENGER SLIDE

[75] Inventors: Klaus Becker; Jürgen Cittrich; Karl-Ernst Kaufmann, all of Wetter (Ruhr), Fed. Rep. of Germany

[73] Assignee: Demag A.G., Duisburg, Fed. Rep. of Germany

[21] Appl. No.: 722,065

[22] Filed: Sep. 9, 1976

[30] Foreign Application Priority Data

Sep. 9, 1975 [DE] Fed. Rep. of Germany ..... 2540044

[51] Int. Cl.[2] ..... A63G 21/00

[52] U.S. Cl. ..... 272/56.5 R; 104/69; 104/134; 193/2 R; 248/357

[58] Field of Search ..... 272/56.5 R, 56.5 SS, 272/66; 193/2 R, 2 A, 35 J, 35 R; 248/357; 104/69, 70, 72, 73, 134, 135, 136, 139; 404/2, 3; 403/263, 244; 256/13.1; 61/14, 15

[56] References Cited

U.S. PATENT DOCUMENTS

| | | | |
|---|---|---|---|
| 2,189,691 | 2/1940 | Travers | 272/56.5 R |
| 2,927,513 | 3/1960 | Dove | 256/13.1 X |
| 3,237,903 | 3/1966 | Dommann et al. | 248/357 |
| 3,376,707 | 4/1968 | Dommann | 248/357 X |
| 3,508,405 | 4/1970 | Koch | 61/14 |
| 3,970,300 | 7/1976 | von Wendt et al. | 272/56.5 R |

FOREIGN PATENT DOCUMENTS

| | | | |
|---|---|---|---|
| 210,241 | 5/1909 | Fed. Rep. of Germany | 193/35 R |
| 1,034,568 | 7/1958 | Fed. Rep. of Germany | 248/357 |

*Primary Examiner*—Richard C. Pinkham
*Assistant Examiner*—Arnold W. Kramer
*Attorney, Agent, or Firm*—Mandeville and Schweitzer

[57] ABSTRACT

The invention covers a passenger slide with bearings or ties installed at a slope, with length-adjustable interlocking supports resting on the bearings for the slide segments which fit on the tubular carriers arranged at the upper end of the length-adjustable supports.

9 Claims, 4 Drawing Figures

PASSENGER SLIDE

BACKGROUND AND STATEMENT OF THE INVENTION

This type of slide was disclosed in German Pat. No. DT-OS 2,213,268 U.S. Pat. No. 3,970,300. The length-adjustable supports or telescoping struts of that slide are mounted on the bearings to be movable in all directions. This complicates the assembly of the trough-shaped slide segments whose edges rest on the tubular carriers or rails. Nuts and counter-nuts are provided for height adjustment of the length-adjustable supports, and a relatively great effort is required to adjust these nuts and counter-nuts. The bearings consist of wooden thresholds or ties which are very expensive and hard to transport in difficult terrain.

It is the object of the invention to create a simplified support for slide segments. This is done by providing a transverse tie or support bearing which consists of a profile bar equipped near its two ends, on top, with terminal pieces of the length-adjustable or telescoping supports, and by having each support, with its upper end, penetrate or inserted into the carrier by a bore hole accessible from underneath. Preferably the terminal pieces are welded onto the bearings in a workshop and brought to the site as a structural unit. The bearings are then installed at the slope whereby rods anchored in the ground ensure that the bearings stay in place. The carriers are then placed onto the length-adjustable supports which penetrate into the carriers through the bore holes and their upper end rests at the upper interior wall of the carriers. The carriers adapt to the inclination of the respective slide segment.

Furthermore, the invention provides lift-off guards to to be attached to the supports below the carriers, and extensions of the butt straps attached to the lateral faces of the slide segments reach under the lift-off guards. The extensions surround the supports and thus prevent, besides lift-off, any slipping of the segments on the bearings. The butt straps have beaded edges or rounded ends surrounding the edge of the segments' lateral faces and are attached with screws. The beaded edge reinforces the border of the slide segment consisting of asbestos concrete in the areas of screw joints which are under particular stress. Preferably the length-adjustable supports consist of an exterior tube with thread and clamp screw to tighten an interior tube inserted into the exterior tube. The thread exists within a nut welded onto the exterior tube so that the length-adjustable supports consist of simple commercial means. Another detail of the invention has the diameter of the previously mentioned boreholes in the carriers by about 25% greater than the diameter of the support which is height-adjustable and penetrates into the carrier by the bore hole, so that the carrier can move freely on the length-adjustable support to adapt to the inclination of the slide segment.

Preferably, the bearing has a U profile open toward the top and may be equipped with another length-adjustable center support between the two length-adjustable supports at each end in order to give better support to the slide segments. The flanges of the U-shaped bearing are preferably interconnected in the center by an intermediate web; a bore hole leads through the intermediate web as well as through the bearing web located below, and the height-adjustable center support passes through the bore hole, and is thus protected against tilting. Preferably, the center support consists of a threaded bar complete with adjustable nut, as well as of a large bearing head. Preferably the length-adjustable center support may be removed from the bearing for approximate setting of the height and may be set to the estimated length in upright position without the use of any tools. A bent position is only required for later exact adjustment.

DESCRIPTION OF THE DRAWINGS

The drawings illustrate the invention in conjunction with a snowless recreational slide mounted on the slope of a hill.

DETAILED DESCRIPTION OF THE INVENTION

Figure 1:
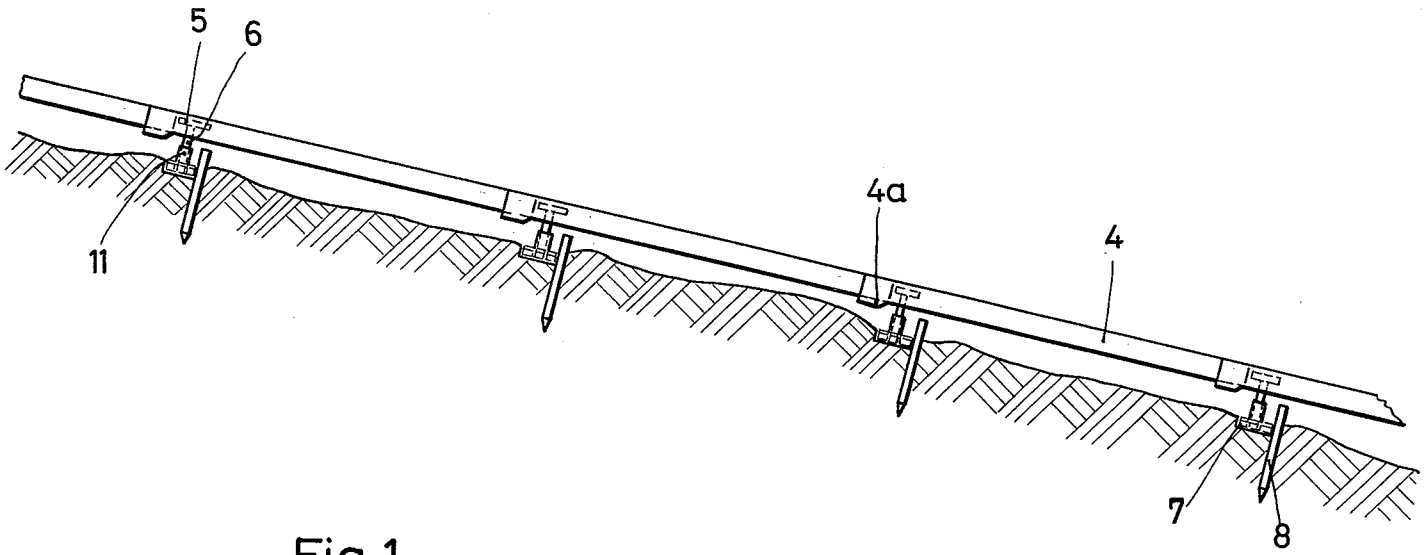
FIG. 1 is a side elevational view of a portion of a recreational slide and showing the spaced bearings or ties of the invention.
Figure 2:
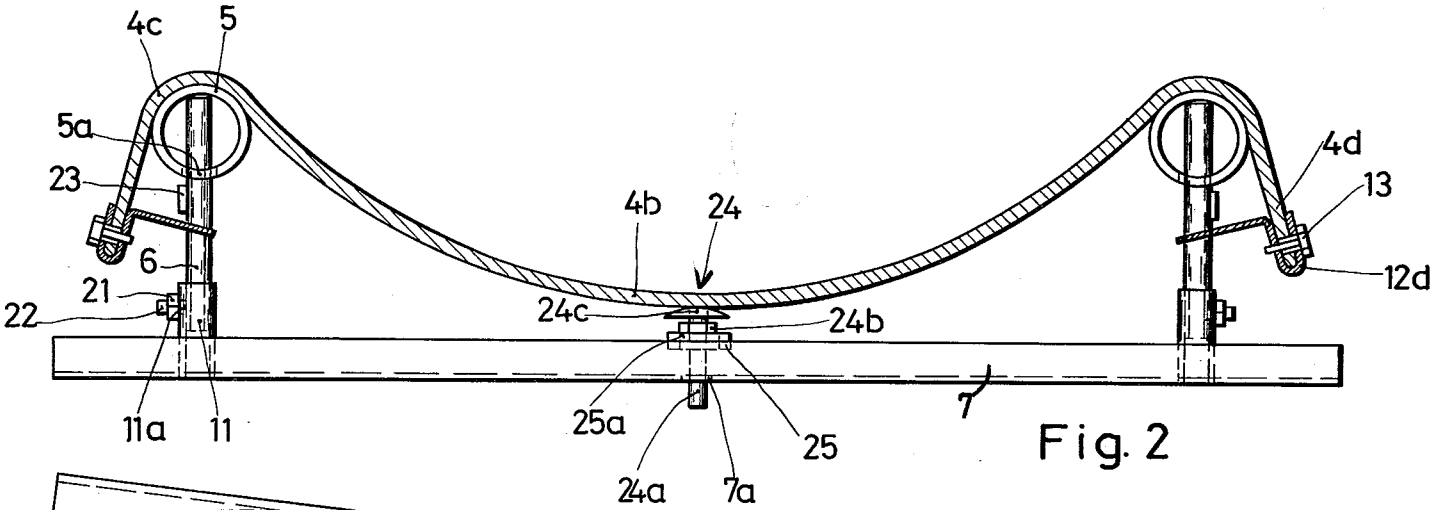
FIG. 2 is an enlarged cross sectional view of the slide of FIG. 1.

FIG. 1 illustrates how bearings or ties 7 are installed at a hillside and protected against slipping by rods 8 anchored in the ground. Lower terminal pieces 11 are attached to bearings 7 for length-adjustable or telescoping supports 6, on which carriers 5 fit according to the incline of slide segments 4. The upper end of each segment of the slide has underlap **4*a*** which receives the lower end of the following segment.

Figure 3:
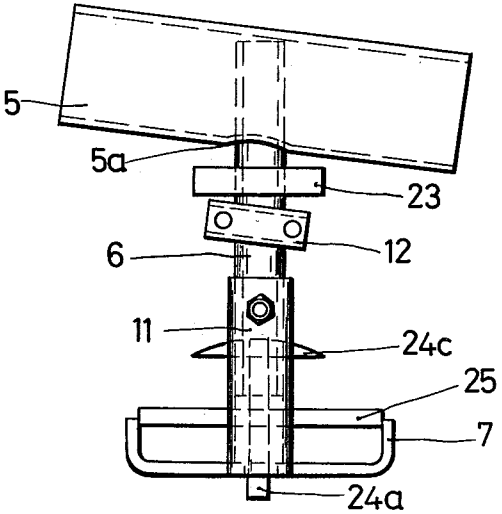
FIG. 3 is an enlarged side elevational view of one of the bearing structures of the invention.

FIG. 3 shows bearing 7 in U-shaped profile, with the legs positioned upwardly, equipped with tubular terminal pieces 11 for length-adjustable supports 6, which penetrate such terminal pieces 11. Terminal pieces 11 are welded on the upper part of the web of bearing 7, and the latter is positioned below edges **4*a* of slide segments 4. The averted sides of terminal pieces 11 come with welded nuts 21 for adjusting screws 22 penetrating through bore holes 11*a* of terminal pieces 11 and clamping down on length-adjustable supports 6 telescoped in terminal piece 11 when tightened, whereas when they are loosened they facilitate axial displacement of length-adjustable supports 6 in terminal pieces 11. The upper end of length-adjustable supports 6 penetrates bore holes 5*a* of tubular carriers 5 whose interior tube wall fits on the length-adjustable supports 6 and support slide segments in edges 4*c*. Lift-off guards 23 are welded to length-adjustable supports 6 below carriers 5**.

Figure 4:
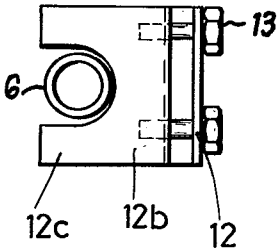
FIG. 4 is an enlarged top plan view of the lift-off guard structure of the invention.

FIG. 4 illustrates how on both sides of length-adjustable supports 6 extensions **12*c* of angles 12*b* of butt straps 12 catch under lift-off guards 23, butt straps 12 being provided with beaded or rounded edges 12*d*, and surrounding the lower edge of lateral faces 4*d* of slide segments 4. Butt straps 12 are attached to lateral faces 4*d* by means of screws 13**.

Intermediate web 25 is welded to the center of bearing 7 between the flanges of the latter. Bore holes **7*a* and 25*a* pass through intermediate web 25 and the web of bearing 7 for threaded rod 24*a* of center support 24 resting on intermediate web 25 with adjusting nut 24*b*, and whose large bearing head 24*c* supports the center of slide segment 4**.

We claim:

1. An artificial downhill run, comprising (a) a plurality of prefabricated elongated slide segments placed end to end to form said run;
(b) a plurality of anchored spaced apart transverse bearings positioned along said run;
(c) each of said segments including integral flanges along each side edge thereof;
(d) tube-shaped rail means extending longitudinally along each side edge of said run for supporting said flanges;
(e) strut means extending between each of said bearings and said rail means on each side of said run; the improvement characterized by
(f) each of said strut means being rigidly attached to said bearings;
(g) said rail means including a bore hole in the bottom surface thereof adjacent each strut means;
(h) each of said strut means extending through its adjacent bore hole in said rail means;
(i) butt straps extending between each said strut means and the adjacent integral flange of said segments;
(j) a butt strap extension on each said butt strap; and
(k) a lift-off guard fixed to each strut means and engaging the top surface of each butt strap extension.

2. The apparatus of claim 1, further characterized by
(a) each said butt strap extension surrounds the adjacent strut means on three sides.

3. The apparatus of claim 1, further characterized by
(a) each of said butt straps includes a curved extension for engaging the end of the said adjacent integral flange of said segments.

4. An artificial downhill run, comprising
(a) a plurality of prefabricated elongated slide segments placed end to end to form said run;
(b) a plurality of anchored spaced apart transverse bearings positioned along said run;
(c) each of said segments including integral flanges along each side edge thereof;
(d) tube-shaped rail means extending longitudinally along each side edge of said run for supporting said flanges;
(e) strut means extending between each of said bearings and said rail means on each side of said run; the improvement characterized by
(f) each of said strut means being rigidly attached to said bearings;
(g) said rail means including a bore hole in the bottom surface thereof adjacent each strut means;
(h) each of said strut means extending through its adjacent bore hole in said rail means;
(i) each of said bearings is U-shaped in cross section and positioned with the legs thereof extending upwardly; and
(j) a length adjustable center support extending between each said bearing and said segments, said center support positioned equidistant between said strut means on each end of said bearings.

5. The apparatus of claim 4, further characterized by
(a) each of said strut means is a telescoping tube structure with the lower portion fixed to said adjacent bearing and the upper portion extending through said bore hole; and
(b) screw means for holding said telescoping portions fixed at various positions with respect to each other.

6. The apparatus of claim 5, further characterized by
(a) said screw means including a nut fixed to the outside surface of said lower portion.

7. The apparatus of claim 4, further characterized by
(a) the diameter of each said bore hole is about 25% greater than the diameter of its respective strut means.

8. The apparatus of claim 4, further characterized by
(a) an intermediate web extending and fixed on said legs of each said bearing;
(b) a central bore hole extending through said intermediate web and said bearing; and
(c) said central bore hole receiving said center support.

9. The apparatus of claim 8, further characterized by
(a) said center support including a threaded rod received in said central bore hole, said threaded rod including a large bearing head for engaging the bottom surface of said adjacent segment.

* * * * *